US006389724B1

(12) United States Patent
Cumberland

(10) Patent No.: US 6,389,724 B1
(45) Date of Patent: May 21, 2002

(54) PHOTOGRAPH MOUNTING ASSEMBLY

(76) Inventor: Holly S. Cumberland, 3550 Cross creek La., Malibu, CA (US) 90265

( * ) Notice: Subject to any disclaimer, the term of this patent is extended or adjusted under 35 U.S.C. 154(b) by 0 days.

(21) Appl. No.: 09/583,162

(22) Filed: May 30, 2000

Related U.S. Application Data

(63) Continuation-in-part of application No. 09/200,498, filed on Nov. 25, 1998, now Pat. No. 6,101,752.

(51) Int. Cl.[7] ..... A47G 1/06
(52) U.S. Cl. ..... 40/778; 40/777; 40/773
(58) Field of Search ..... 40/778, 771, 768, 40/773, 702, 159.1, 661.09, 594

(56) References Cited

U.S. PATENT DOCUMENTS 945,710 A * 1/1910 Doxsee ..... 40/778
1,895,599 A * 1/1933 Zimmer ..... 40/778
3,023,678 A * 3/1962 Tschentschel ..... 40/778
3,256,979 A * 6/1966 Tschentschel ..... 40/778
3,346,979 A * 10/1967 Milos ..... 40/778
4,479,318 A * 10/1984 Russell ..... 40/154
5,433,023 A * 7/1995 Edwards et al. ..... 40/159.1
5,570,906 A * 11/1996 Giulie ..... 281/42

* cited by examiner

*Primary Examiner*—Anthony Knight
*Assistant Examiner*—Mark Williams
(74) *Attorney, Agent, or Firm*—Brian B. Shaw, Esq.; Stephen B. Salai, Esq.; Harter, Secrest & Emery LLP

(57) ABSTRACT

A photograph retaining assembly is disclosed, wherein a backing substrate has an adhesive layer on one side and a plurality of retaining pockets on a second side. The retaining pockets formed to preclude perforation of the backing substrate.

7 Claims, 5 Drawing Sheets

FIG.1
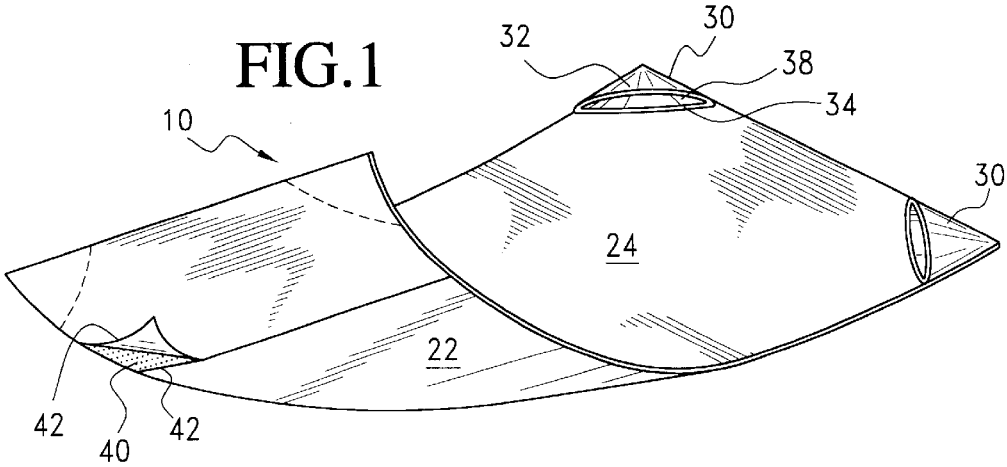
FIG.2
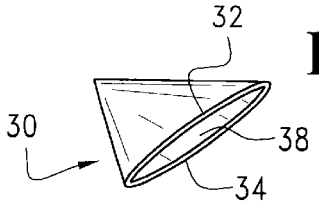
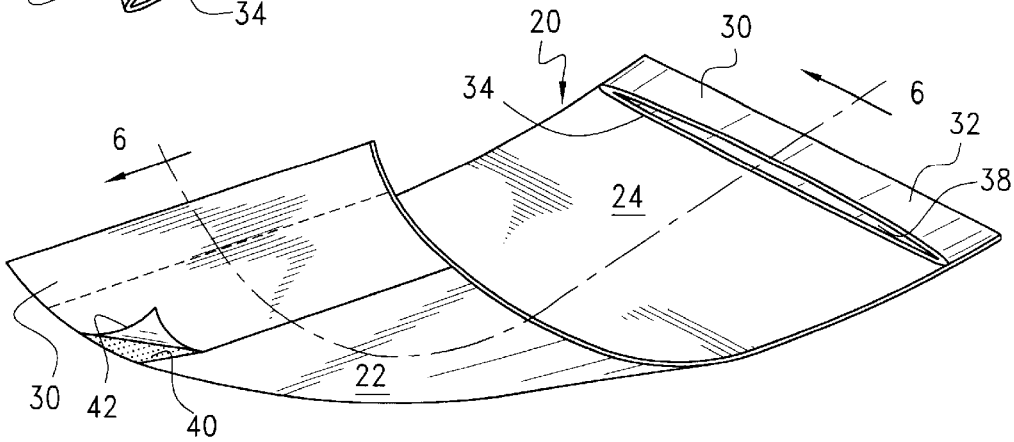
FIG.3
FIG.4
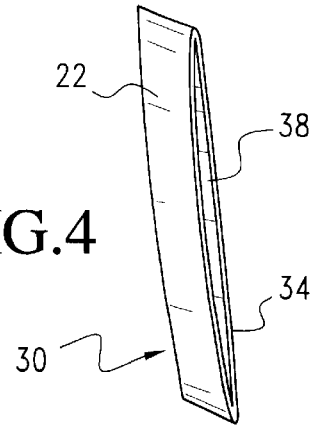

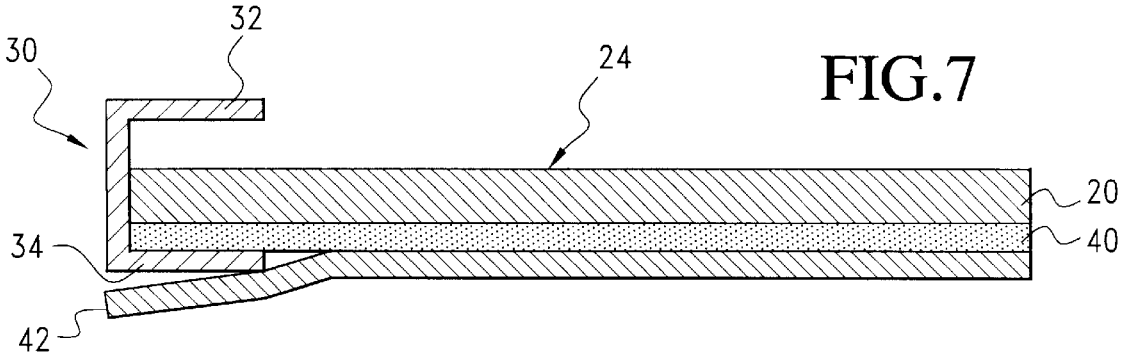
FIG.7
FIG.8
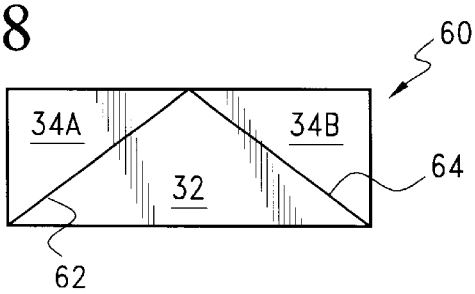
FIG.9
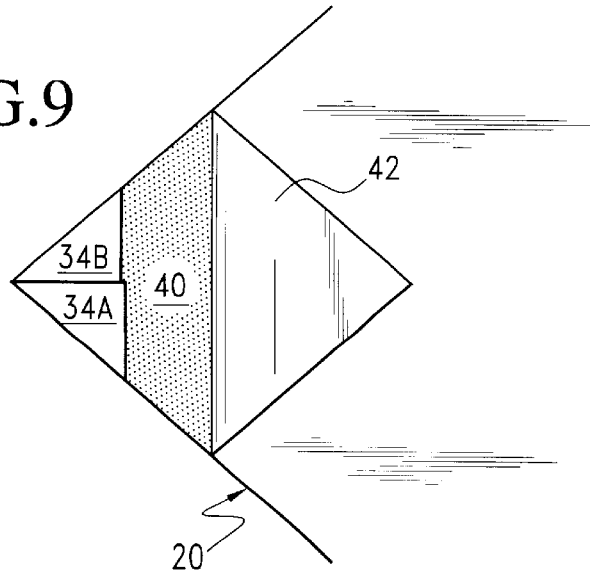

PHOTOGRAPH MOUNTING ASSEMBLY

The present application is a Continuation-in-Part of U.S. Ser. No. 09/200,498 filed Nov. 25, 1998 now U.S. Pat. No. 6,101,752 in the name of Holly S. Cumberland.

FIELD OF THE INVENTION

The present invention relates to an assembly for releasably mounting images, and more particularly to the releasable retention of a photograph to a page, wherein the photograph and a mount are simultaneously aligned with each and may be adhered to the page as a single element.

BACKGROUND OF THE INVENTION

The storage and display of images, such as photographs often significantly contributes to their value. That is, if a picture is never displayed, its value will likely not be realized. Even if the picture is displayed, the mounting of the picture may contribute to its degradation. That is, many current mounting components tend to deteriorate over time, thereby creating the risk of releasing the photograph from the mount. In addition, some mounts may actually degrade the retained photograph. This deterioration of the photograph may result from contact or exposure of the mount to the photograph. Chemicals from the mount may leech into the photograph and distort the image quality.

A further problem exists in mounting a picture to a given page in a desired location. Thus, misalignment often occurs. Devices employed for mounting pictures have utilized double-sided adhesive stickers which were stuck to the back of picture at the corners and then stuck to a mounting sheet by moistening the stickers. However, these adhesives are generally harmful to the photograph or prohibitively expensive.

Alternatively, slits in a mounting sheet have been used to retain a photograph with respect to the sheet. The slits are cut in the sheet and allow no user modification. Thus, there is no ability to locate the photograph in a particular location on a page.

Therefore, the need exists for a retention system that can retain a photograph without exposing the photograph to damaging adhesives. The need also exists for a system in which photographs are operably aligned with a mount or retainer, and the combination can be readily aligned with a page. A further need exists for a system that can be readily located with respect to a page such that a resulting location of the photograph is visible during the mounting process.

SUMMARY OF THE INVENTION

The present invention provides a mounting system that allows a photograph to be operably retained with respect to the mount and the combined photograph and mount to be located with respect to a support. The invention is particularly directed to mounting planar images such as photographs with respect to a support such as a page in an album.

The present invention includes a backing substrate having an adhesive on one planar surface that retains the backing substrate with respect to the support and a second planar surface of the backing substrate having a plurality of overlay areas, configured as retaining pockets, to retain a portion of a periphery of the photograph.

The present invention provides a mount for photographs, wherein no plastic layer is disposed over the face of the photograph to retain the photograph. Only a portion of the periphery of the photograph is covered in the present invention. Further, the portion of the periphery may be a corner or an edge of the photograph.

The present invention offers the benefit of simultaneously locating the photograph and associated mount to a page of a photo album. Specifically, the present invention obviates the need to locate and temporarily retain multiple individual comer supports to an album page. By providing a system having all the retaining pockets affixed to a substrate, the photograph and the substrate will not be subject to unintended separation, and accurate alignment with the album page is readily achieved.

BRIEF DESCRIPTION OF THE DRAWINGS

FIG. 1 is a perspective view of a first embodiment of the present invention.

FIG. 2 is a perspective view of a retaining pocket in the first embodiment.

FIG. 3 is a perspective view of a second embodiment of the invention.

FIG. 4 is a perspective view of an expanded retaining pocket for receiving a portion of the periphery of a planar image.

FIG. 7 is a partial cross-sectional view of an alternative construction.

FIG. 8 is a top plan view of a pocket-forming element.

FIG. 9 is a partial perspective view of the substrate and alternative pocket configuration.

DETAILED DESCRIPTION OF THE PREFERRED EMBODIMENT

Figure 5:
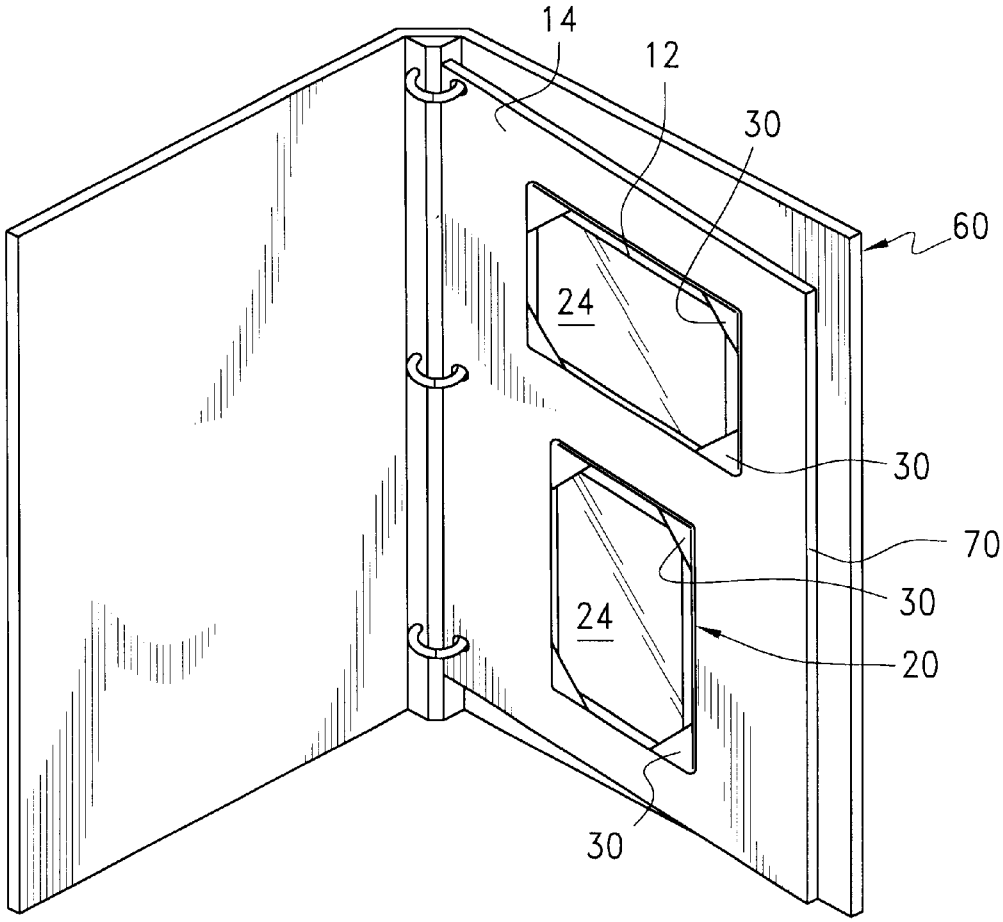
FIG. 5 depicts a support bearing two mounted backing substrates.

As shown in FIGS. 1 and 5, the present invention provides a mounting system 10 for locating a planar image 12 with respect to a support 14. The planar image 12 may be a print, a painting a photograph, drawing or other image. For purposes of the present description, the planar image 12 is set forth as a photograph. The support 14 may be a wall, a tabletop, or any surface with which the planar image 12 is to be displayed. For purposes of the present description, the support 14 is a page in a photo album.

Generally, the present invention includes a backing substrate 20 and a plurality of retaining pockets 30.

FIG. 1 shows a first embodiment of the invention including the backing substrate 20. Preferably, the backing substrate 20 has a first and a second planar surface 22, 24. The first planar surface 22 includes the adhesive material 40 and the second planar surface 24 contacts a rear surface of the photograph. The adhesive material 40 may be any variety of materials such as permanent or releasable adhesives. Preferably, the backing substrate 20 is non-degrading with respect to the planar image 12. A backing substrate 20 sold under the trademark CHARTPAK by Chartpak of Massachusetts has been found to be an acceptable material. The backing substrate 20 is impervious to the adhesive material 40 so that migration of the adhesive material from the first surface 22 to the second surface 24 is substantially precluded. Preferably, the adhesive layer 40 is initially covered by a releasable film 42 that is readily removed to expose the adhesive layer.

The second surface 24 of the backing substrate 20 includes the retaining pockets 30. The retaining pockets 30 are formed by an overlying member 32 that overlies a portion of the backing substrate 20. The overlying member 32 may be a portion of the backing substrate that has been folded to overlie the second surface 24. Alternatively, the overlying member 32 may be a separately formed member that is attached to the second surface 24 of the backing substrate 20. In a further configuration, the retaining pocket 30 may have a bottom 34 and the overlying member 32 joined along three sides, or so as to define a pocket having an opening 38. An outside of the bottom 34 will be joined to the second surface 24 of the backing substrate 20. The retaining pocket 30 may be joined to the backing substrate 20 by any of a variety of mechanisms such as adhesives, welding heat treating or other fixedly attaching process. The retaining pockets 30 have the opening 38 into which a portion of the planar image 12 is received. The retaining pockets 30, shown in FIG. I and FIG. 2, are constructed to encompass a corner of the planar image 12 to be retained. The retaining pockets 30 are preferably formed of an archival material that will not degrade the planar image 12.

The retaining pockets 30 may separately formed from the backing substrate 20 and affixed to the substrate at any location. Thus, a user may identify the desired location of the planar image 12 with respect to the backing substrate 20 and affix the retaining pockets 30 at the required locations to the second surface 24. The planar image 12 is then engaged by the retaining pockets 30 and the backing substrate 20 and engaged planar image 12 are bonded to the page.

Preferably, the retaining pocket 30 is sufficiently affixed to the backing substrate 20 so that non destructive separation is substantially precluded.

The retaining pockets 30 may have any of a variety of configurations. The retaining pockets 30 may engage a corner of the planar image 12, or an edge of the planar image 12. FIG. 3 shows a second embodiment in which retaining pockets 30 extend along an entire dimension of the planar image 12 along a periphery. FIG. 4 shows the opening 38 which permits retention of a planar image 12.

FIG. 5 shows a configuration of the invention in which a planar image 12 is retained by the retaining pockets 30 with respect to the backing substrate 20. A page 70 of a photo album 60 holds two of the mounting assemblies.

Figure 6:
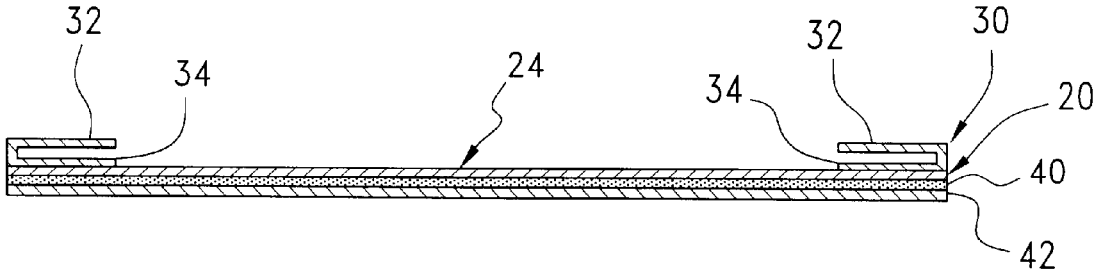
FIG. 6 is an exaggerated cross sectional view taken along lines 6—6 of FIG.3.

FIG. 6 shows a cross sectional view taken along line 6—6 of FIG. 3 in which the retaining pocket 30 includes the overlying member 32 and the bottom 34 adhered to the second surface 24 of the backing substrate 20. The backing substrate 20, in turn, has the adhesive layer 40 with the releasable filth 42.

Thus, the planar image 12 may be displayed without the use of a plastic overlay. Any damage that may result from extended contact between the planar image 12 and a plastic overlay is reduced. In addition, the planar image 12 is readily visible without the distorting effects of a plastic overlay. It is contemplated the backing substrate 20 may be sized and include sufficient retaining pockets 30 to locate two or more planar images 12. Further, the backing substrate 20 may be sized to accommodate any of a variety of photograph sizes.

The present invention offers the benefit of locating the planar image 12 and associated mounting system 10 to a page in the photo album. In prior systems, a user had to balance a corner mount on all four comers of the photograph and then align the photograph with the page, trying to place a balanced corner mounts and photo on the page. In these prior systems, a corner mount invariably fell off or the photograph was misaligned. By mounting the planar image 12 to the substrate 20 prior to aligning with the support, wherein the substrate and the photograph are not subject to unintended separation, the present invention thus allows accurate alignment with the album page.

In use, the protective film 42 is removed, thereby exposing the adhesive 40. The adhesive 40 and substrate 20 is then affixed to the support 14, with or without the planar image 12. The second surface 24 of the backing substrate 20 has previously adhered retaining pockets 30 which are ready to receive a planar image 12. Simply by inserting an edge of the planar image 12 into the opening 38, the planar image is easily mounted relative to the backing substrate 20.

ALTERNATIVE CONFIGURATIONS

The connection of the retaining pocket 30 to the backing substrate 20 may also be achieved as set forth in FIG. 7. As shown in FIG. 7, a portion of the film 42 is separated from the adhesive 40 adjacent an edge or comer of the substrate 20. An inside surface of the bottom 34 of the retaining pocket 30 is adhesively connected to the adhesive 40 such that a portion of the substrate 20 is disposed within the pocket opening 38, and the overlying member 32 overlies the second planar surface 24.

This attachment of the retaining pocket 30 may be provided for retaining pockets located at the corners or peripheral edges of the substrate 20.

As a portion of the retaining pocket 30 will overlie the photograph, preferably at least the overlying member 32 is formed of an archival material. Thus, the retaining pocket may be of a different material than the substrate 20.

An advantage of this construction is the continuous and uninterrupted nature of the second point of surface 24 throughout the footprint of the photograph. That is, the photograph is not subjected to folds or bends or creases at the corners or periphery, wherein these folds, bends or creases may be formed from overlying an edge of a laminate structure. In addition, this construction provides for the adhesive-free retention of the photograph.

In addition, it is contemplated the retaining pocket 30 maybe formed by the selective folding of an elongate strip or web of archival material 60. Specifically, shown in FIG. 8, the retaining pocket 30 forming strip 60 includes a pair of intersecting fold lines 62, 64 to form the overlying member 32 and the bottom 34, as shown by flaps 34A and 34B.

Referring to FIG. 9, a portion of the underside of the substrate as shown, wherein the flaps 34A and 34B forming the bottom of the retaining pocket 30 are shown adhered to the adhesive 40.

From this configuration, the mounting assembly maybe provided that as the bottom 34 of the retaining pocket 30 is contacted to a portion of the adhesive 40, the overlying film 42 maybe readily grasped in the area of the bottom 34 so that the user may readily remove the film 42 and thus expose a remaining portion of the adhesive 40.

Figure 10:
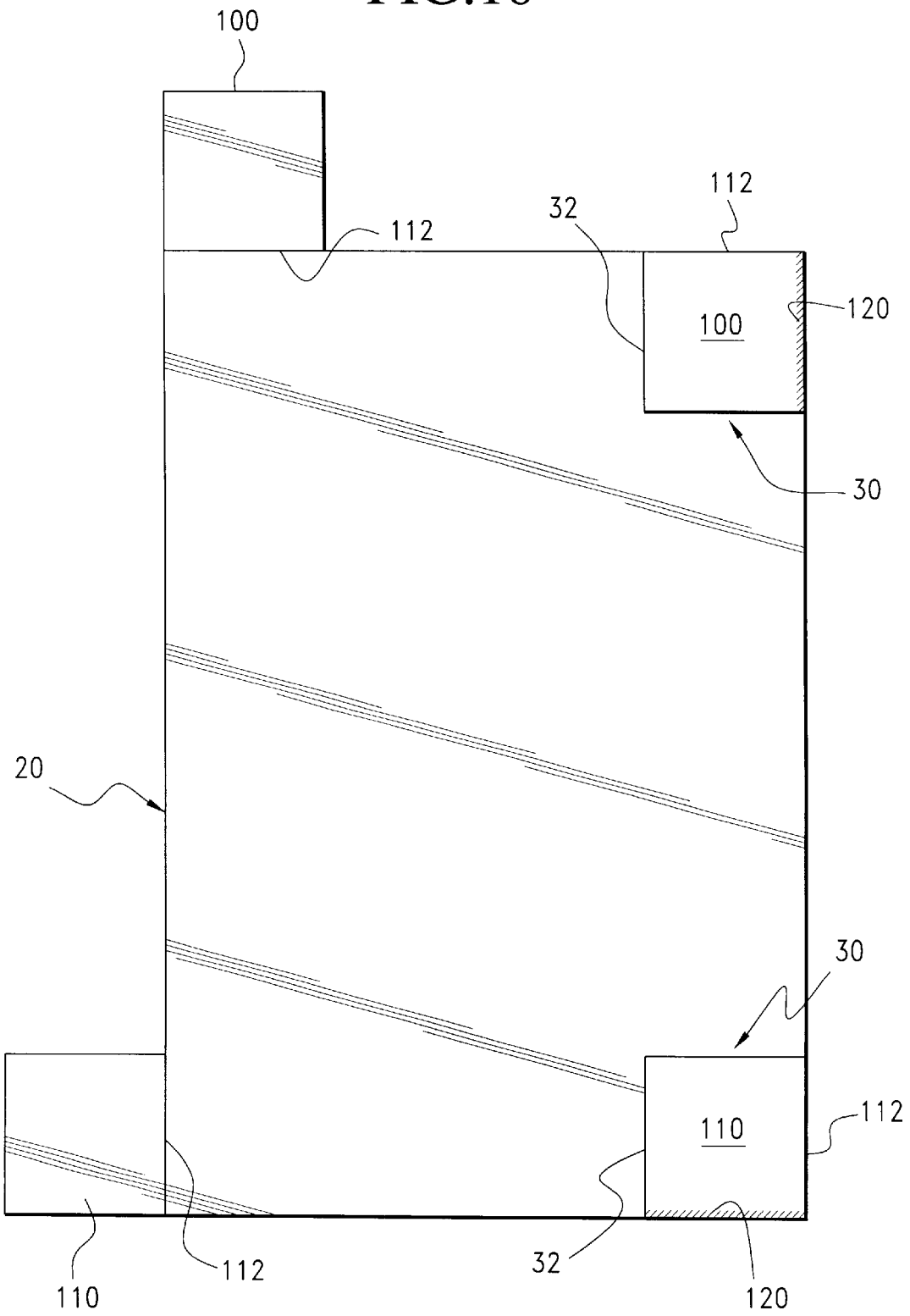
FIG. 10 is a top plan view of a further configuration of the mount assembly.

Referring to FIG. 10, the substrate 20 may be formed or die cut to include flaps which form the pocket 30. In particular, the substrate 20 may include end flaps 100 or side flaps 110 which are folded with respect to the remaining portion of the substrate to form the pocket 30. As shown in the upper left hand comer FIG. 10, end flap 100 is connected to the substrate 20 by fold line 112. To form the pocket, the end flap 100 is folded along fold line 112 and a seam 120 is formed to define the pocket 30O. The seam 120 may be formed by any of a variety of mechanisms including adhesives, glues, welding and ultrasonic attachment as shown in the upper right hand comer of FIG. 10. The pocket 30 is partially defined by the fold line 112 and the seam 120, wherein the flap forms the overlying portion.

As shown in bottom left hand comer of FIG. 10, a side flap 110 is attached to the substrate 20 along a fold line 112. To form the pocket 30 as shown in the lower right hand comer of FIG. 10 the side flap 110 is folded along fold line 112 and the seam 120 is formed along the bottom edge of the substrate.

Figure 11:
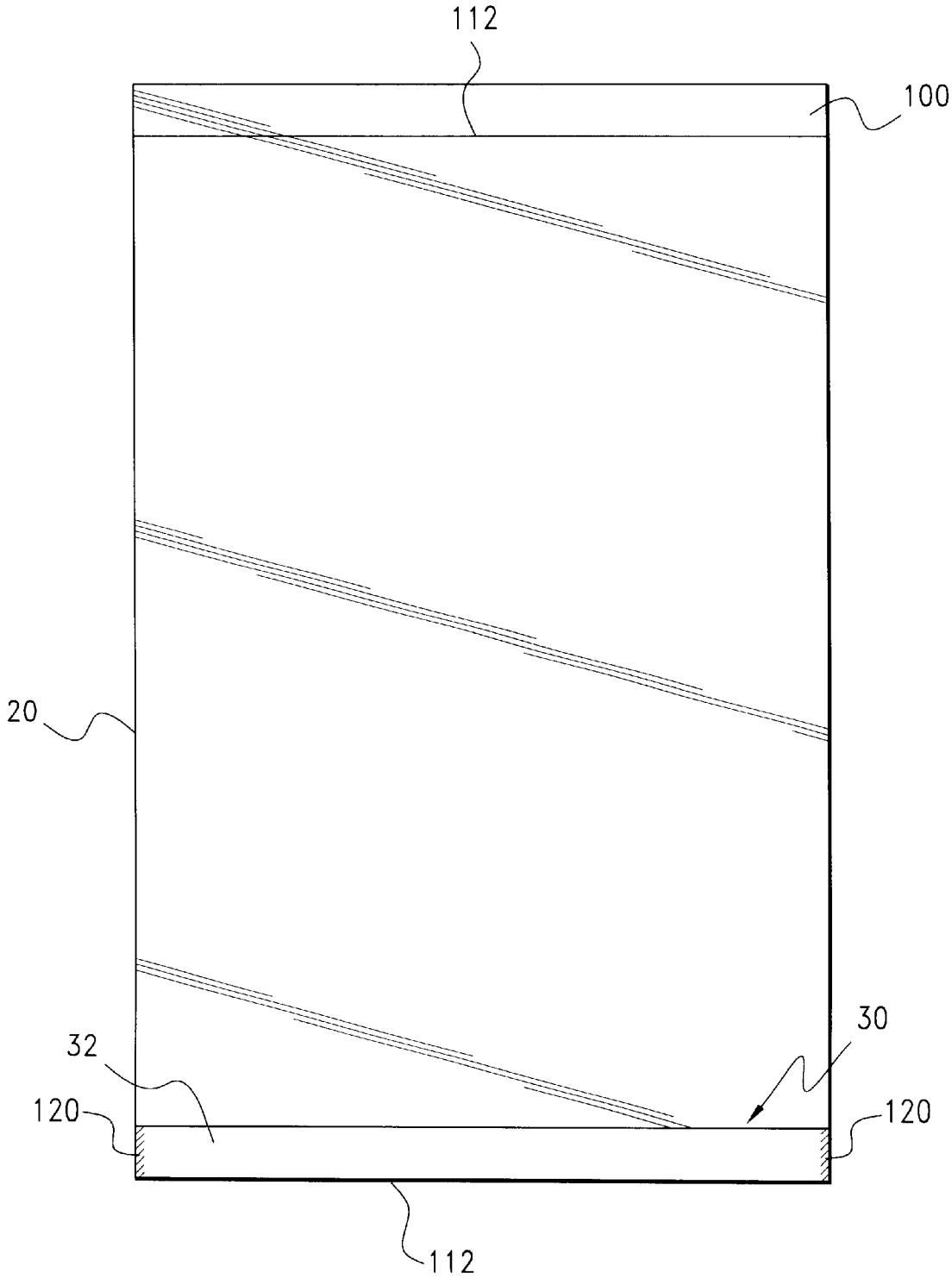
FIG. 11 is a top plan view of further alternative construction of the mount assembly.

Referring to FIG. 11, the end flap 100 may extend across the entire width of substrate 20 along fold line 112. As shown in the bottom of FIG. 11, the pocket 30 is formed by folding end flap 100 about fold line 112 and forming seam 120 along the short edges of the pocket 30.

While the invention has been described with reference to preferred embodiments, it will be understood by those skilled in the art that various changes may be made and equivalents may be substituted for elements thereof without departing from the scope of the invention. In addition, many modifications may be made to adapt a particular situation of material to the teachings of the invention without departing from the scope of the invention. Therefore, it is intended that the invention not be limited to the particular embodiments disclosed as the best mode contemplated for carrying out this invention, but that the invention will include all embodiments falling within the scope and spirit of the appended claims.

What is claimed:

1. A mount for releaseably retaining a planar image relative to a support surface, comprising:

(a) a backing substrate having a first planar surface and a second planar surface defined by a periphery, the backing substrate being of a size able to accommodate an entire planar image;

(b) an adhesive layer on the first planar surface of the backing substrate for bonding the backing substrate to the support surface;

(c) a removable film on the adhesive layer, the film being removable for bonding the backing substrate to the support surface; and (d) at least two retaining pockets on the second planar surface of the backing substrate adjacent the backing substrate periphery, each of the pockets having a bottom wall and an overlying wall, each wall formed of a different material than the backing substrate, and defining a pocket opening for receiving a peripheral portion of the planar image, the bottom wall having an inner surface connected to the adhesive layer to preclude non-destructive separation, a portion of the overlying wall overlying the second planar surface of the backing substrate.

2. The mount of claim 1, wherein the retaining pocket has a rectangular periphery.

3. The mount of claim 1, wherein the retaining pocket has a triangular periphery.

4. The mount of claim 1, wherein the retaining pocket is formed of a single piece of material having a pair of intersecting fold lines.

5. A mount assembly for releaseably retaining a planar surface relative to a support surface, comprising:

(a) a backing substrate having a first planar surface and a second planar surface defined by a periphery, the backing substrate being sized to accommodate an entire planar image on the first planar surface;

(b) an integral retaining flap foldably connected to the periphery along a fold line;

(c) a retaining pocket formed between the backing substrate and retaining flap, the retaining pocket including a first closed side at the fold line and a second closed side formed by a seam between the retaining flap and the backing substrate, the retaining pocket releaseably receiving a peripheral portion of the planar image;

(d) an adhesive layer on the second planar surface of the substrate for bonding the backing substrate to the support surface; and (e) a releasable film overlying the adhesive layer, the film being released to expose the adhesive layer for bonding the backing substrate to the support surface.

6. The mount assembly of claim 5, wherein the backing substrate has a rectangular periphery.

7. The mount assembly of claim 6, wherein the retaining flap extends a length of one edge of the rectangular periphery.

* * * * *